US011708767B2

(12) United States Patent
Cox et al.

(10) Patent No.: US 11,708,767 B2
(45) Date of Patent: Jul. 25, 2023

(54) VARIABLE VANE ARM MECHANISM FOR GAS TURBINE ENGINE AND METHOD OF OPERATION

(71) Applicant: PRATT & WHITNEY CANADA CORP., Longueuil (CA)

(72) Inventors: Edward Cox, Oakville (CA); Daniel Poick, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/471,733

(22) Filed: Sep. 10, 2021

(65) Prior Publication Data

US 2023/0078588 A1 Mar. 16, 2023

(51) Int. Cl.
*F01D 17/16* (2006.01)
*F01D 9/04* (2006.01)

(52) U.S. Cl.
CPC ..... *F01D 17/162* (2013.01); *F01D 9/041* (2013.01); *F05D 2260/79* (2013.01)

(58) Field of Classification Search
CPC .... F01D 17/162; F01D 17/165; F01D 25/243; F01D 9/041; F01D 17/105; F01D 17/16; F01D 17/20; F01D 25/24; F01D 25/28; F01D 9/042; F04D 29/563; F04D 27/002; F04D 27/023; F04D 27/0246; F04D 29/4213; F05D 2240/12; F05D 2260/79; F05D 2260/74; F05D 2270/58; F02B 37/186; F02B 37/24; F02C 7/042
See application file for complete search history.

(56) References Cited

U.S. PATENT DOCUMENTS

| | | | | |
|---|---|---|---|---|
| 2,778,564 | A | 1/1957 | Halford et al. | |
| 3,356,288 | A * | 12/1967 | Corsmeier | F01D 17/162 415/149.4 |
| 3,954,349 | A * | 5/1976 | Abild | F01D 17/162 415/163 |
| 3,990,809 | A * | 11/1976 | Young | F01D 17/162 74/96 |
| 6,527,508 | B2 * | 3/2003 | Groskreutz | F01D 17/165 415/164 |
| 7,850,421 | B2 * | 12/2010 | Battig | F01D 17/162 415/160 |
| 7,886,536 | B2 | 2/2011 | Hemer | |
| 10,294,856 | B2 | 5/2019 | Lotz | |
| 2015/0176418 | A1 * | 6/2015 | Marshall | F01D 9/04 415/1 |
| 2017/0114658 | A1 * | 4/2017 | King | F01D 17/167 |

* cited by examiner

*Primary Examiner* — Eric J Zamora Alvarez
(74) *Attorney, Agent, or Firm* — Norton Rose Fulbright Canada LLP

(57) ABSTRACT

The variable vane arm mechanism can have an actuator ring defined around a main axis, a set of vanes having a plurality of vanes circumferentially distributed around the main axis, each vane having a vane axis extending from an inner end to an outer end and being rotatable around the vane axis, each vane having a vane arm, a plurality of pins circumferentially distributed around a main axis, slide blocks engaged with corresponding ones of the pins in a manner to rotate around the pins, and guide slots having a length extending away from corresponding ones of the vane axes, each guide slot slidingly receiving a corresponding slide block.

20 Claims, 7 Drawing Sheets

VARIABLE VANE ARM MECHANISM FOR GAS TURBINE ENGINE AND METHOD OF OPERATION

TECHNICAL FIELD

The application relates generally to gas turbine engines and, more particularly, to variable guide vanes (VGV) which can be associated to a compressor section thereof.

BACKGROUND OF THE ART

In gas turbine engines, compressors can have one or more sets of blades which rotate around the main axis during operation and compress air along the main gas path of the engine. Vanes are airfoil components which also extend across the gas path, typically adjacent to a set of rotor blades, but which do not rotate around the main axis. Vanes can be used to guide/direct the air onto the rotor blades at an angle of incidence which is chosen in a manner to optimize engine performance and efficiency. Since the optimal angle of incidence can vary as a function of operating conditions, it was known to use variable guide vanes (VGV) to change the angle of incidence to keep the angle of incidence suitable in different operating conditions. Variable guide vanes, like non-variable guide vanes, typically do not rotate around the engine main axis, but can be mounted in a manner to rotate around an axis extending along their length, across the main gas path, in a manner to allow changing the angle of the vane chord relative to the gas path.

While existing variable guide vane systems were satisfactory to a certain degree, there always remains room for improvement. Indeed, each set of vanes includes a plurality of vanes which are circumferentially distributed around the main axis. Depending on the configuration of the main gas path, the vanes can individually extend perfectly radially around the main engine, or slope towards the front or towards the rear to a certain extent. Variable guide vane systems typically aim to change the angle of incidence of all vanes of the set simultaneously and uniformly relative to the gas path, and to this end can require a suitable mechanism with several moving parts. Such mechanisms may need to be designed with a number of elements taken into consideration such as weight, cost, reliability, durability/wear, maintenance costs, etc., and improvement appeared to remain possible at least in some embodiments.

SUMMARY

In one aspect, there is provided a variable vane mechanism comprising: a casing; an actuator ring having an annular body defined around a main axis, the actuator ring being rotationally mounted to the casing for rotation around the main axis; a set of vanes including a plurality of vanes circumferentially distributed around the main axis, each vane of the set of vanes having a vane axis extending from an inner end to an outer end, the inner end and the outer end being rotationally mounted to the casing to allow rotation of the corresponding vane around the vane axis, the vane axes extending non-parallel to the main axis, each vane having a vane arm with a vane arm length extending transversally to the main axis; a first one of the actuator ring and the vane arms having a plurality of pins circumferentially distributed around the main axis, each pin extending along a pin axis; a plurality of slide blocks, each slide block rotationally mounted to a corresponding one of said pins for rotation around the pin axis, each slide block having two slide block faces facing transversally opposite sides relative the pin axis; a second one of the actuator ring and the vane arms having a plurality of guide slots, each guide slot having a length extending away from a corresponding vane axis, each guide slot slidingly receiving a corresponding one of the slide blocks with each one of the two slide block faces slidingly received by a corresponding guide slot face of the corresponding guide slot.

In another aspect, there is provided a gas turbine engine comprising a casing defining a gas path extending sequentially across a compressor section, a combustor and a turbine section, the gas path extending annularly around a main axis, at least one rotor rotatably mounted to the casing for rotation around the main axis, the rotor having a set of blades forming part of the compressor section, a set of vanes including a plurality of vanes circumferentially distributed around the main axis, the set of vanes being adjacent the set of blades along the gas path, each vane having a vane length extending across the gas path and being rotationally mounted at two opposite ends for rotation along a vane axis extending between the two opposite ends, each vane having a vane arm extending away from the vane axis at one of the two opposite ends; an actuator ring having an annular body formed around the main axis, the actuator ring being rotationally mounted to the casing for rotation around the main axis, a first one of the actuator ring and the vane arms having a plurality of pins circumferentially distributed around the annular body, each pin protruding along a pin axis; a plurality of slide blocks, each slide block rotationally mounted to a corresponding one of said pins for rotation around the pin axis, each slide block having two slide block faces facing transversally opposite sides relative the pin axis; a second one of the actuator ring and the vane arms having a plurality of guide slots, each guide slot having a length extending away from a corresponding vane axis, each guide slot slidingly receiving a corresponding one of the slide blocks with each one of the two slide block faces slidingly received by a corresponding guide slot face of the corresponding guide slot.

In a further aspect, there is provided a method of operating a variable vane arm mechanism having an actuator ring defined around a main axis, a set of vanes having a plurality of vanes circumferentially distributed around the main axis, each vane having a vane axis extending from an inner end to an outer end and being rotatable around the vane axis, each vane having a vane arm, a plurality of pins circumferentially distributed around a main axis, slide blocks engaged with corresponding ones of the pins in a manner to rotate around the pins, and guide slots having a length extending away from corresponding ones of the vane axes, each guide slot slidingly receiving a corresponding slide block, the method comprising: rotating the actuator ring around a main axis, the rotation of the actuator ring pivoting the vane arms and thereby rotating the corresponding vanes around the vane axes, via sliding of the slide blocks in the guide slots and rotation of the slide blocks around the guide pins, the sliding of the slide blocks in the guide slots occurring obliquely relative the length of the guide slots.

DESCRIPTION OF THE DRAWINGS

Reference is now made to the accompanying figures in which:

FIGS. 2A, 2B and 2C are top, front and lateral schematic views, respectively, of an example variable vane mechanism in a first configuration;

DETAILED DESCRIPTION

Figure 1:
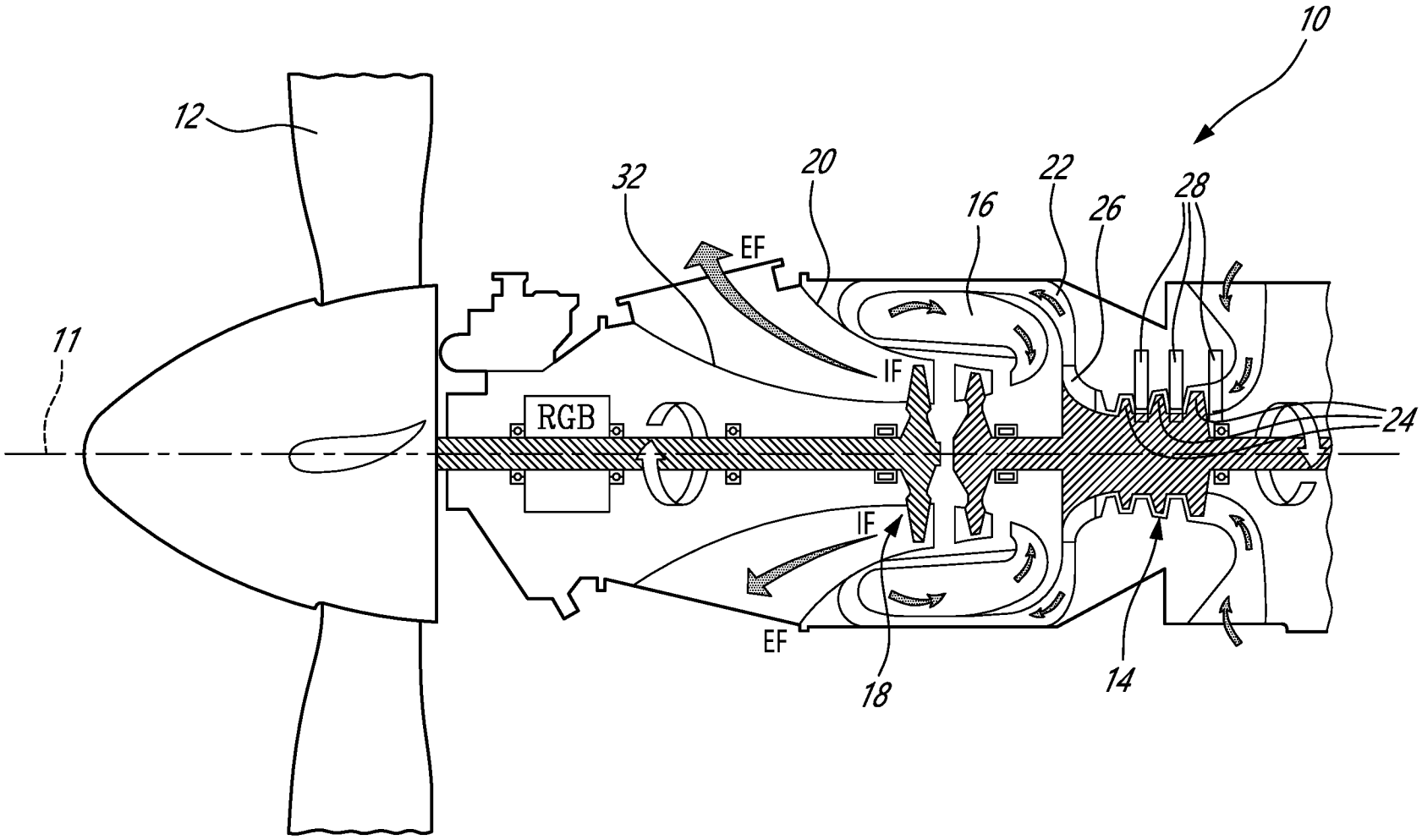
FIG. 1 is a schematic cross-sectional view of a gas turbine engine.

FIG. 1 illustrates an example of a turbine engine. In this example, the turbine engine 10 is a turboprop engine generally comprising in serial flow communication along a main gas path 22, a multistage compressor 14 for pressurizing the air, a combustor 16 in which the compressed air is mixed with fuel and ignited for generating an annular stream of hot combustion gases around the main axis 11, and a turbine section 18 for extracting energy from the combustion gases. The turbine engine terminates in an exhaust section 20. The main gas path 22 can be delimited mainly by corresponding walls of a casing 32.

In the embodiment shown in FIG. 1, the turboprop engine 10 has two stages, including a high pressure stage associated to a high pressure shaft, and a low pressure stage associated to a low pressure shaft. High pressure turbine stage is associated to the high pressure shaft, and a low pressure turbine stage is associated to the low pressure shaft. The low pressure shaft is used as a power source to drive a propeller 12 in this embodiment. The compressor section can have a rotor associated to the high pressure shaft, for instance, as is the case in this embodiment.

As is the case in other types of gas turbine engines, such as turbofan engines and turboshaft engines, the compressor 14 can have one or more rotor, having one or more sets of blades 24. One or more of the sets of blades 24 can be axial, meaning that the blades of the set are provided in the form of elongated airfoil sections circumferentially distributed around the main axis 11 and extending across the annular gas path 22, and which can collectively be rotated for each blade to move circumferentially around the gas path 22 and work the fluid medium.

Although the gas path 22 is typically annular, the shape it takes along the length of the engine main axis 11 can vary from one embodiment to another. Indeed, it can extend relatively straight, or along curved portions. Accordingly, to extend suitably across the gas path, typically roughly transversal to the gas path, and depending on the position of a given set of blades 24 along the length of the gas path 22, it can be suitable for the blades to extend radially relative the main axis 11 (e.g. across a straight, axially-oriented section of the gas path 22), or to slope towards the front or towards the rear (e.g. across an oppositely sloping section of the gas path 22. The compressor 14 can also have a centrifugal compressor section 26, which typically involve a relatively complex swirling blade geometry defining an axial inlet and a radial outlet. In the specific embodiment presented in FIG. 1, the main gas path 22 extends in a reverse orientation, from the rear to the front, and a single rotor includes three axial compressor blade sets 24 followed by a centrifugal compressor section 26. Other configurations are possible in alternate embodiments.

Depending on the specific embodiment, one or more sets of vanes 28 can be used in relation with one or more corresponding sets of blades 24. Vanes are airfoil components which also extend across the gas path 22, but which do not rotate around the main axis 11. Each set of vanes 28 includes a plurality of vanes which are circumferentially distributed around the main axis 11. Vanes of one set of vanes 28 can be used to direct the air onto the blades of the corresponding set of blades 24 at an angle of incidence (e.g. swirl angle) which is designed to optimize engine performance and efficiency. With this purpose in mind, each set of vanes 28 can be positioned adjacent a corresponding set of blades 24 along the length of the gas path 22. Since the optimal angle of incidence can vary as a function of operating conditions, one or more of the set(s) of vanes 28 can be a set of variable guide vanes (VGV). The vanes of a set of variable guide vanes can be configured in a manner to allow changing the angle of incidence as a function of varying operating conditions, and allow to keep the angle of incidence suitable or optimal in different operating conditions. Variable guide vanes, like non-variable guide vanes, typically do not rotate around the main axis. However, variable guide vanes, by contradistinction with non-variable guide vanes, can be mounted in a manner to rotate around a vane axis extending along their length, across the main gas path, in a manner to allow changing the angle of the vane chord relative to the gas path. As for blades, depending on the shape of the main gas path 22 and their position along it, the vanes can individually extend perfectly radially around the main engine, or slope towards the front or towards the rear to a certain extent.

In the illustrated embodiment three sets of vanes 28 are associated to corresponding ones of the three sets of blades 24. Variable guide vanes are typically part of a variable guide vane system which includes a mechanism operable to change the angle of incidence of all vanes of the set simultaneously and uniformly. Such mechanisms may need to be designed with a number of elements taken into consideration such as weight, cost, reliability, durability/wear, maintenance costs, etc., and improvement appeared to remain possible at least in some embodiments.

Figure 2A:
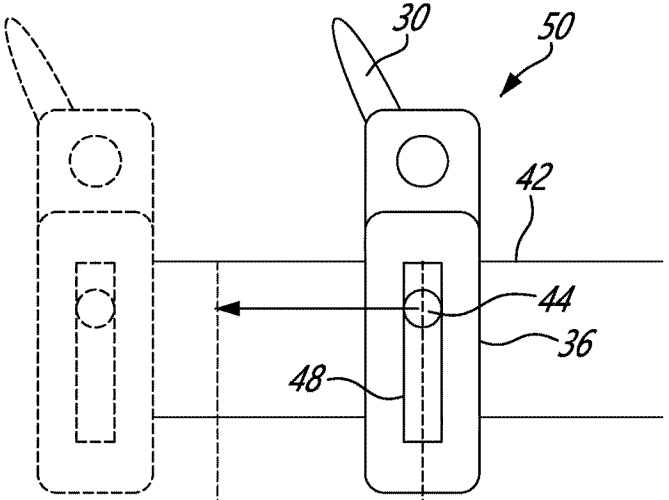
Figure 2B:
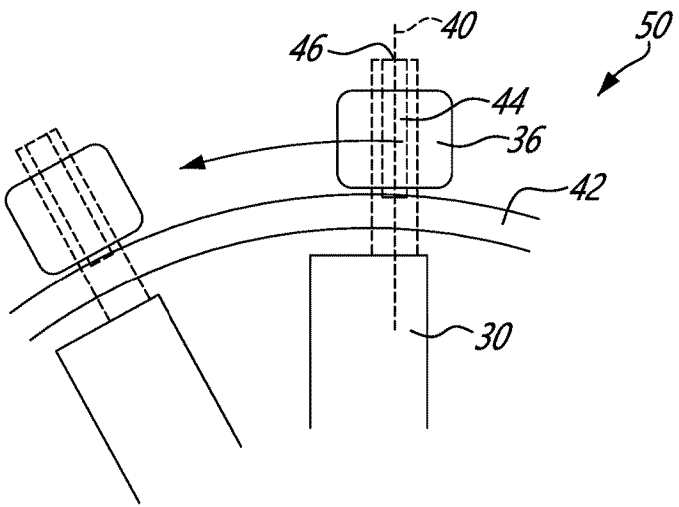
Figure 3A:
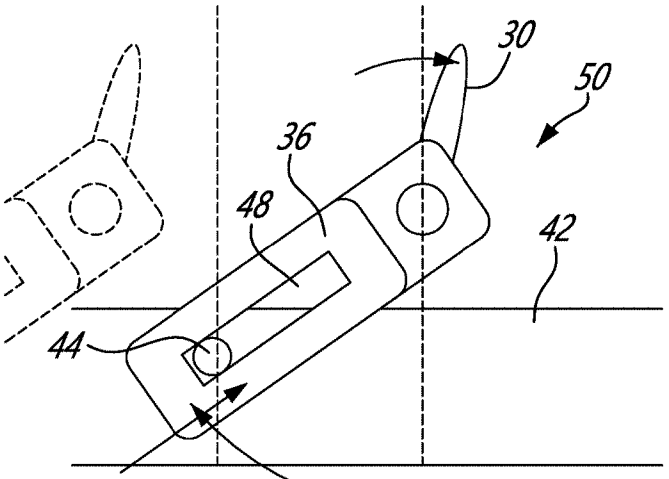
FIGS. 3A, 3B and 3C are top, front and lateral schematic view, respectively, of the variable vane mechanism of FIGS. 2A, 2B and 2C in a second configuration.
Figure 3B:
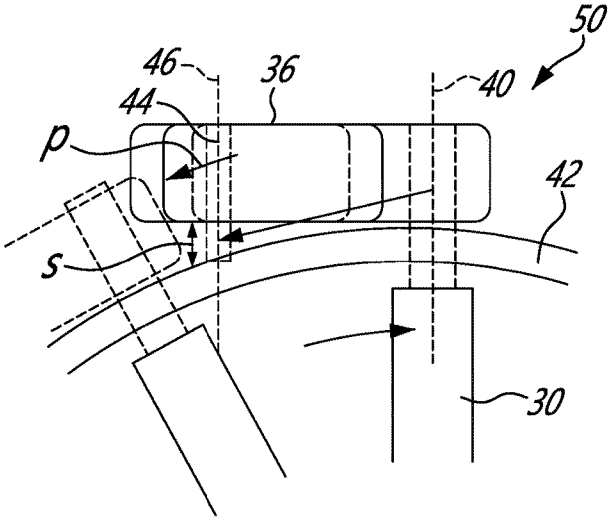
Figure 3C:
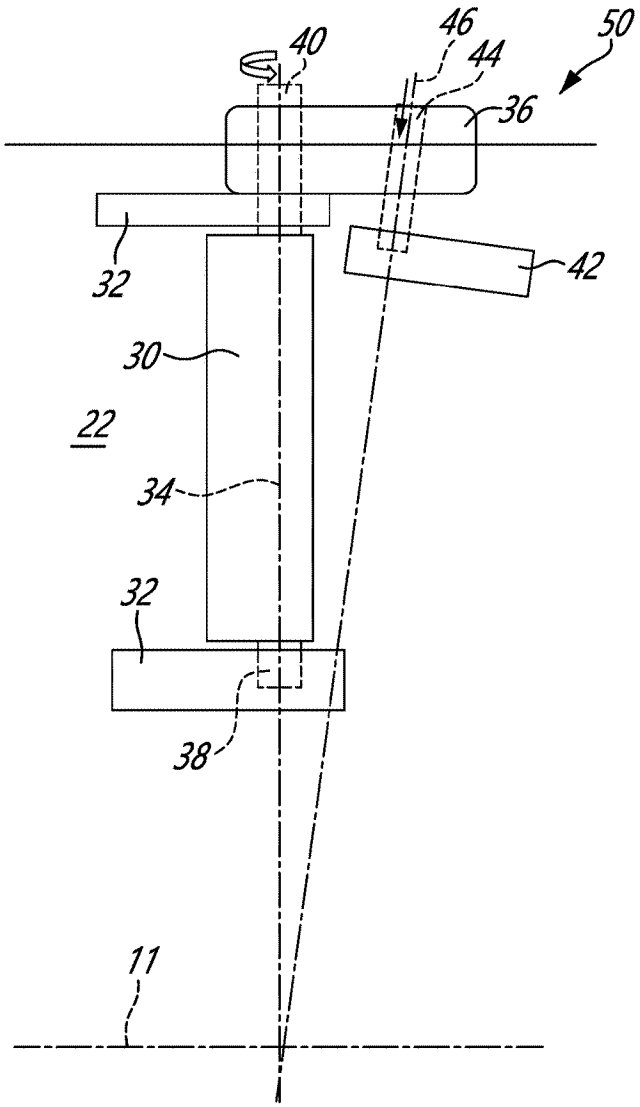
Figure 3D:
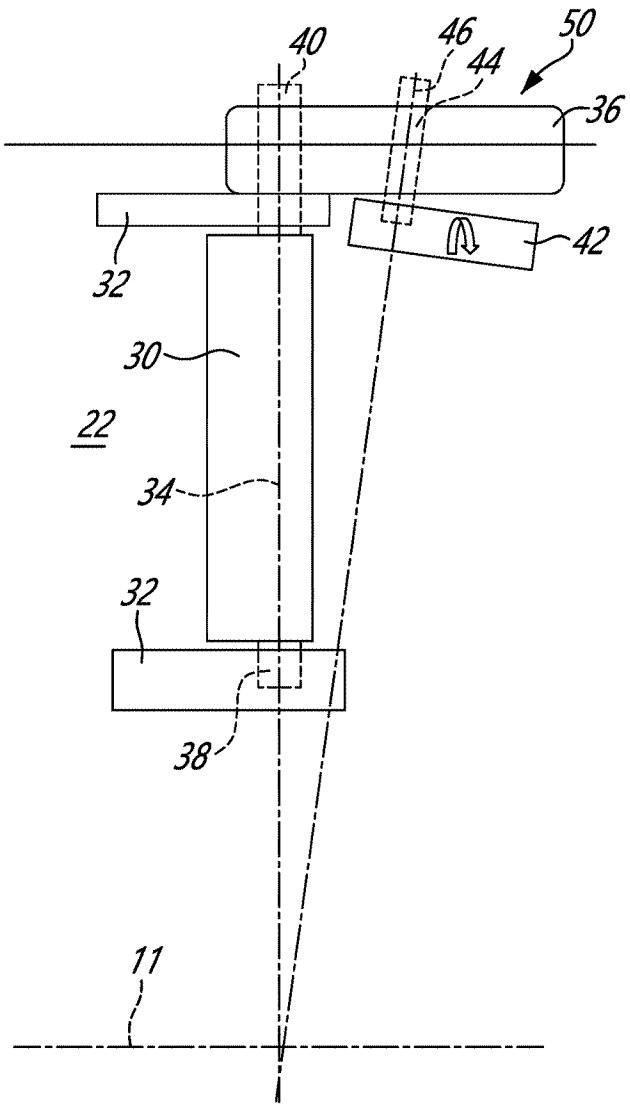

One type of mechanism, which can be used to simultaneously and uniformly change the angle of incidence of all vanes of a set is schematized in FIGS. 2A to 3C. In this embodiment, and as best seen in FIGS. 2C and 3C, each vane 30 is rotationally mounted to casing components 32 at both ends, in a manner to be rotatable around a vane axis 34. The vane axes 34 are non-parallel to the main axis 11. In the embodiment illustrated, the vane axes 34 extend in a radial orientation relative the main axis 11, and are thus disposed in a common virtual plane which is normal to the main axis. In alternate embodiments, the vane axes 34 can extend obliquely relative the main axis 11 and thus be disposed in a common virtual conical surface (i.e. it may slope to the front or to the rear to accommodate curvature and/or inclination of the local portion of the gas path). The vane axes 34 are non-parallel to the main axis 11. All vanes of a given set can be identical, or, in some embodiments, some vanes of a given set can be different from others. The ends of the vanes 30 can be referred to as a (radially) inner end 38 and a (radially) outer end 40 relative to the main axis 11, independently of whether the vane axis 34 is oblique or perfectly radial.

A vane arm 36 can extend from one end of the vanes 30, such as the outer end 40 for instance. The vane arm 36 can have a length, which will be referred to herein as the vane arm length, extending transversally or obliquely relative the vane axis 34 in a manner to pivot around the vane axis 34 when the vane 30 rotates around the vane axis 34, and vice-versa, a movement best seen in comparing FIGS. 2A and 3A. The vane arm 36 can be said to extend away from the vane axis 34. The pivoting of the vane arms 36 can be controlled in a manner to control the rotation of the vanes 30 and their angle of incidence relative the gas path 22. To this end, a component which can be referred to as the actuator ring 42 can be used.

The actuator ring 42 can extend circumferentially around the main axis 11 and be configured in a manner to be rotatable around the main axis 11, relative the casing 32. A plurality of solid-of-revolution elements which can be referred to herein as pins 44 for simplicity can protrude from the actuator ring 42 and be circumferentially distributed around the actuator ring 42. The pins 44 are defined along axes which will be referred to herein as the pin axes 46. The number of pins 44 and their circumferential distribution can correspond with the number of vanes 30 and the circumferential distribution of the vanes 30, and therefore with the number of vane arms 36. The pin axes 46 are circumferentially distributed around the main axis 11 and extend non-parallel to the main axis 11. Depending on the embodiment, the pin axes 46 can extend radially relative the main axis 11, and thereby all be aligned in a common virtual plane, or, as in the embodiment presented in FIG. 3C, extend somewhat obliquely relative the main axis 11, and thereby all extend along a common virtual conical surface. The vane arms 36 can each be provided with a guide slot 48, best seen in FIGS. 2A and 3A, configured to receive a corresponding pin 44 in sliding engagement. The guide slot can extend along the length of the vane arm 36, and thus transversally relative the vane axis 40. Accordingly, the guide slots 48 can extend away from the vane axis 40.

The mechanism can operate as follows: the actuator ring 42 can be rotated around the main axis by a suitable actuator such as a pneumatic or hydraulic actuator. The rotation of the actuator ring 42 entrains the rotation of the pins 44 which are engaged with corresponding guide slots 48. The pins 44 are configured for sliding-ability in the guide slots 48, and can thus pivot the vane arms 36 as they are circumferentially moved with the actuator ring 42, sliding along the length of the guide slots 48 as they do so. In alternate embodiments, the guide slots 48 can form part of the actuator ring 42 and the pins 44 can form part of the vane arms 36 to provide a very similar functionality, as will be understood by persons having ordinary skill in the art.

It will be understood that since the vane axis 40 around which the vane 30 rotates and the vane arm 36 pivots, and the main axis 11 around which the actuator ring rotates, are non-parallel, the mechanism involves a three-dimensional configuration which is more complex to visualize than if the vane axis 40 was oriented parallel to the main axis 11. The three dimensional configuration increases complexity of the mechanism and also raises a number of potential hurdles.

The vane arms 36, pins 44, guide slots 48 and actuator ring 42 can be said to form part of the variable vane mechanism 50.

Indeed, as shown by comparison between FIGS. 2B and 3B, in which the movement has been exaggerated for clarity, as the actuator ring 42 rotates around the main axis 11, the pin 44 moves circumferentially with it, and the vane arm 36 pivots around the vane axis 40, at which point a circumferential separation s can occur between the circumferential position of the pin 44 and the circumferential position of the vane axis 40, which can create an increasing gap s between the actuator ring and the vane arm, essentially "pulling" the pin 44 downwardly (radially) relative to the guide slot 48 in addition to sliding it along the length of the guide slot 48. The pin 44 can be designed in a manner to accommodate such a downward sliding movement in addition to accommodating the sliding movement along the length of the guide slot 48. Moreover, the pin 44 may pivot p relative to the guide slot 48. Such downward sliding movement and pivoting movement p of the pin 44 can be greater when the circumference of the actuator ring 42 is lower and lower when the circumference of the actuator ring 42 is greater.

Such relative movements must typically be taken into account in the design of practical embodiments. Indeed, in a typical practical embodiment in a gas turbine engine, the amount of play between the pin 44 and the guide slot 48 is typically minimized because the presence of lateral gaps can reduce the angular accuracy of the angle of incidence of the vane and can also entrain delays or minor shocks in vane angular response to actuator ring movement. Accordingly, while play can allow to accommodate relative movements in theory, it is typically not found suitable in practical embodiments.

In some embodiments, the effects of relative pivoting p between the pin 44 and the vane arm 36 can be minimized by designing the mechanism 50 in a manner for the axis 46 of the pins to intersect the vane axis 40 at a point along or near to the main axis 11, such as is the case in the embodiment presented in FIGS. 2C and 3C.

In some embodiments, notwithstanding the care taken to design components in a manner to optimize their relative motions, using a simple pin 44 to slide directly in the guide slot 48, in such complex three dimensional motions, can represent a source of wear which it may be desired to further attenuate. Indeed, wear of the pin along its contact line with the guide slot can cause loss of material, eventually causing a gap to form between the pin and the guide slot, which can result in slop in the system. Slop can introduce minor delays in VGV responsiveness and accelerate the degradation of the guide slot and pin. Wear rate can then further be increased as a result of the minute impacts between the guide slot and pin which may occur at each pitch change.

Figure 4A:
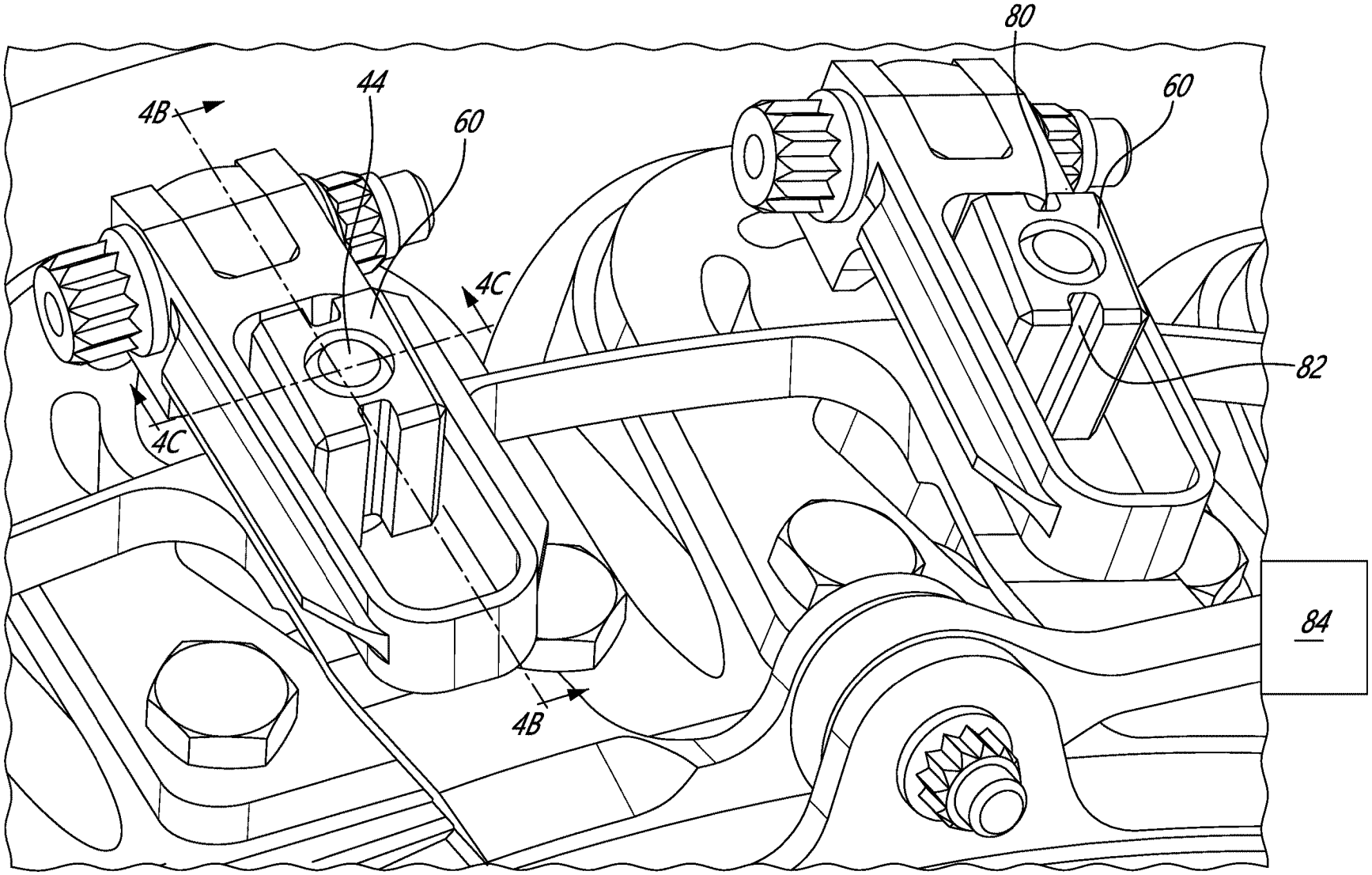
FIG. 4A is an oblique view of a second example variable vane mechanism.
Figure 4C:
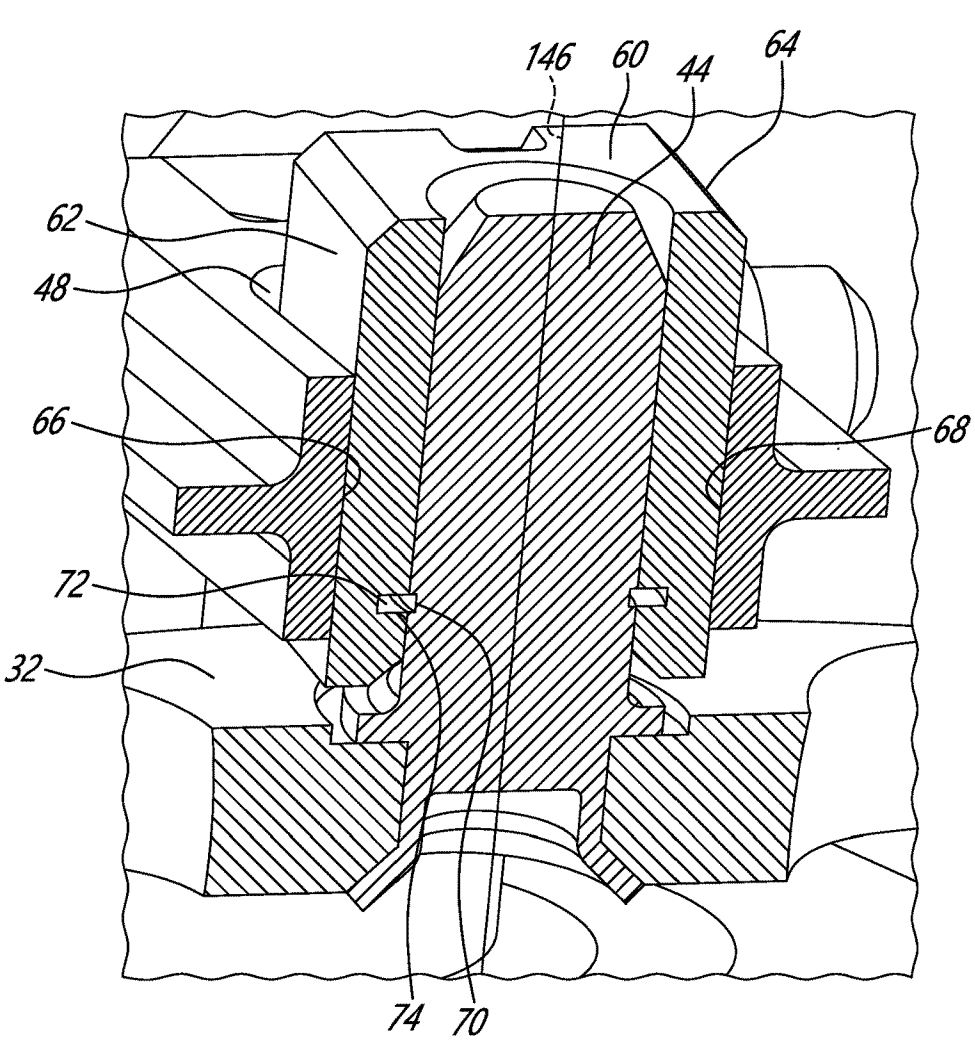
FIG. 4C is a cross-sectional view taken along lines 4C-4C of FIG. 4A.
Figure 4B:
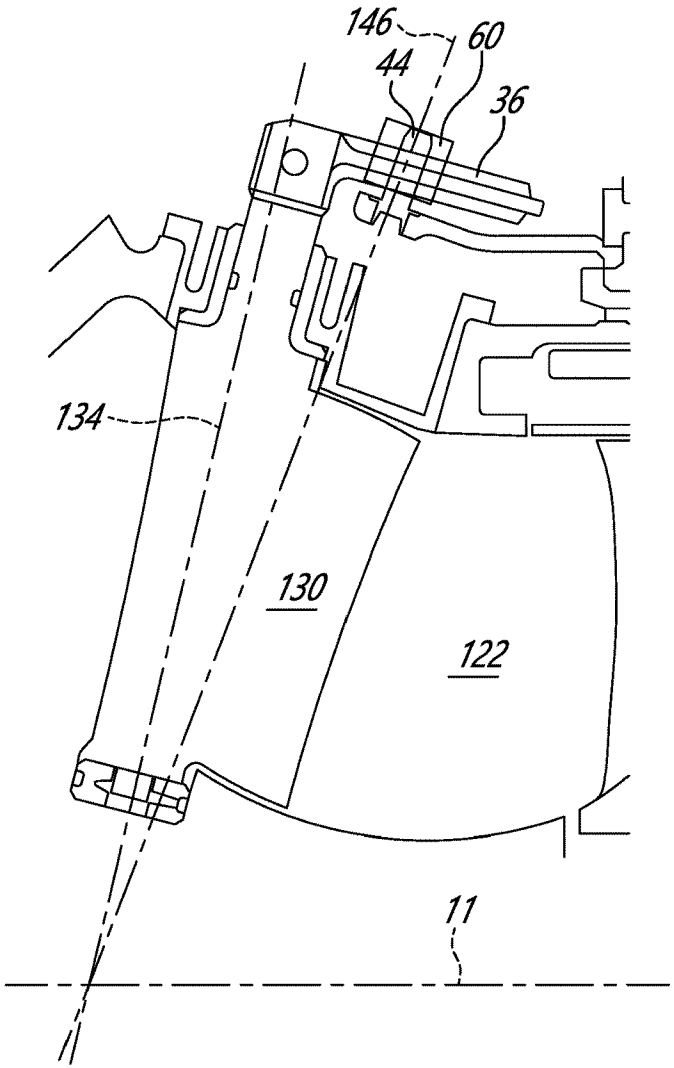
FIG. 4B is a cross-sectional view taken along lines 4B-4B of FIG. 4A.

FIGS. 4A to 4C presents another embodiment. In this latter embodiment, a component referred to as a slide block 60 is introduced and can reduce the effects of wear in some embodiments. The slide blocks 60 can be mounted to corresponding pins 44 in a manner to be rotatable around the corresponding pin axes 146. The slide block 60 can be designed in a manner have two slide block faces 62, 64, which can face transversally opposite sides relative the pin axis 146, and which are configured to offer a smoother and larger sliding surfaces against the corresponding faces 66, 68 of the of the guide slot 48 than a cylindrical pin would have (see FIG. 4C). Moreover, since the slide block 60 rotates around the pin axis 146, it can accommodate the change of angular orientation between the length of the guide slot 48 and the pin 44 as the actuator ring rotates (the movement perhaps best illustrated by comparing FIG. 2A to FIG. 3A. As can be seen in FIG. 4C, the two slide block faces 62, 64 can be planar, flat, and parallel to one another. Moreover, the two guide slot faces 66, 68 can also be planar, flat and parallel to one another. The slide block 60 can form a broader, rotating intermediary between the pin 44 and the guide slot 48, and which may be designed to maintain surface contact throughout the entire actuator stroke.

The general geometry of the vane axes 134, pin axes 146, main axis 11, vane arms 36, guide slots 48, and actuator ring 32 can be generally as described above with reference to FIGS. 2A to 3C, with some exceptions. As perhaps best seen in FIG. 4B, in this embodiment, the vane axis 134 extends obliquely rather than radially relative the main axis. As can be seen, in this embodiment, the variable vanes 130 are used in a curving portion of the main gas path 122 and to operate efficiently, its angle relative to the main axis 11 is selected accordingly. However, it will be noted that here as well, the pin axis 146, around which the slide block 60 is rotatably mounted here, is even further sloping relative the main axis 11. Notwithstanding these angles, the pin axis 146 remains configured to intersect the vane axis 146 roughly around the main axis 11, to facilitate the accommodation of the relative displacements between the vane arm 36 and the pin 44, similarly to how the pin axis 46 and vane axis 34 intersected along the main axis in FIGS. 2C and 3C. The angles can vary strongly from one embodiment to another. In some embodiments, the vane axes 134 can have more than 65 degrees relative the main axis 11, and in some embodiments, both the vane axes 134 and the pin axes 146 can have at least 80 degrees relative the main axis 11.

Accordingly, it will be understood that the movement of the slide block 60 in the guide slot 48 may not be purely along the length of the guide slot 48 when the vane arm 36 pivots, but may be oblique and include a somewhat radially oriented component due to the presence of an increasing spacing s (see FIG. 3B). Such movement may tend to pull or push the slide block 60 along the pin axis 146 over time. To avoid separation of the slide block 60 from the pin 44, a snapping feature may be introduced. For instance, as shown in FIG. 4C, in the illustrated embodiment, the pin 44 is generally cylindrical around the pin axis 146 except for a pin slot 70 formed annularly around its outer circumference at a given axial position. Similarly, the slide block 60 has a pin aperture delimited by an internal wall which is generally cylindrical except for a block slot 72 formed annularly around its inner circumference at a given axial position. A resilient retaining ring 74 can be engaged with a first one of the block slot 72 and pin slot 70 and elastically deformed in a manner to accommodate the engagement of the pin 44 inside the pin aperture until the block slot 72 becomes axially aligned with the pin slot 70, at which point the elastic energy stored in the elastically deformed resilient retaining ring 74 can be released to snap the retaining ring 74 further into the other one of the pin slot 70 and block slot 72, bridging the two, as which point the retaining ring 74 may retain the slide block 60 axially relative the pin 44 in the orientation of the pin axis 146. If the retaining ring 74 is first engaged into the pin slot 70, it can be compressed to accommodate the cylindrical portion of the slide block pin aperture and expand into the block slot 72 upon axial alignment, whereas if the retaining ring is first engaged into the block slot 72, it can be stretched to accommodate the cylindrical portion of the pin 44 and contract upon axial alignment. The engaging end of the pin 44, of the block aperture, or of both the pin 44 and the slot aperture can be beveled in a manner to assist or drive the elastic deformation of the resilient retaining ring 74 prior to its release.

In such an arrangement, it may be required to break the slide block 60 in order to remove it from the pin 44 when maintenance is eventually performed. The slide block 60 can be designed for being split into two pieces by an appropriate splitting tool to this end. For instance, and as exemplified in FIG. 4A, the slide block 60 can be provided with removal grooves 80, 82 to accommodate opposed splitting members of a compressive splitting tool. The removal grooves 80, 82 can be defined parallel to the pin axis 146, and can be provided on opposite removal faces of the slide block. The removal faces can extend between corresponding edges of the slide block faces 62, 64 which are designed for maintaining a surface contact with the corresponding guide slot faces 66, 68.

In the illustrated embodiment, the pins 44 are designed in the form of initially separate components which are riveted to the annular body of the actuator ring 32 in this embodiment, as best seen in FIG. 4C. Other configurations are possible in alternate embodiments. Once assembled, the pins protrude from the annular body and the pin axes extend away from the main axis. The guide slots can be defined along the length of corresponding ones of the vane arms.

A few additional details about one example embodiment are also exemplified in FIG. 4A. An actuator 84, which can be of any suitable type such as pneumatic, hydraulic or electric, can be used to drive the rotation of the actuator ring 32 around the main axis 11. In one example, the actuator 84 can have a cylinder which extends a shaft mounted to a piston received in the cylinder. Such a shaft can be pivotally mounted to the actuator ring at the distal end, such as exemplified in FIG. 4A. Depending on the embodiment, the vane arm can be manufactured integrally with the vane, such as by casting, additive manufacturing or machining, or provided initially as a separate component configured to be assembled to the vane. In the example embodiment of FIG. 4A, the latter avenue was retained and fasteners are used to secure the vane arms to a protruding end of the vanes. In the example embodiment illustrated, the vane arms have a generally rectangular slide with rounded corners. The rounded corners can help reduce stress concentration. Moreover, reinforcing ribs are present on both circumferentially opposite sides of the vane arms which can be useful from a structural point of view in some embodiments. The actuator ring can have a plurality of apertures formed therethrough, as shown, in a manner to optimize the structural characteristics while also factoring in minimization of weight and material costs. Many variations are possible in alternate embodiments.

Figure 5:
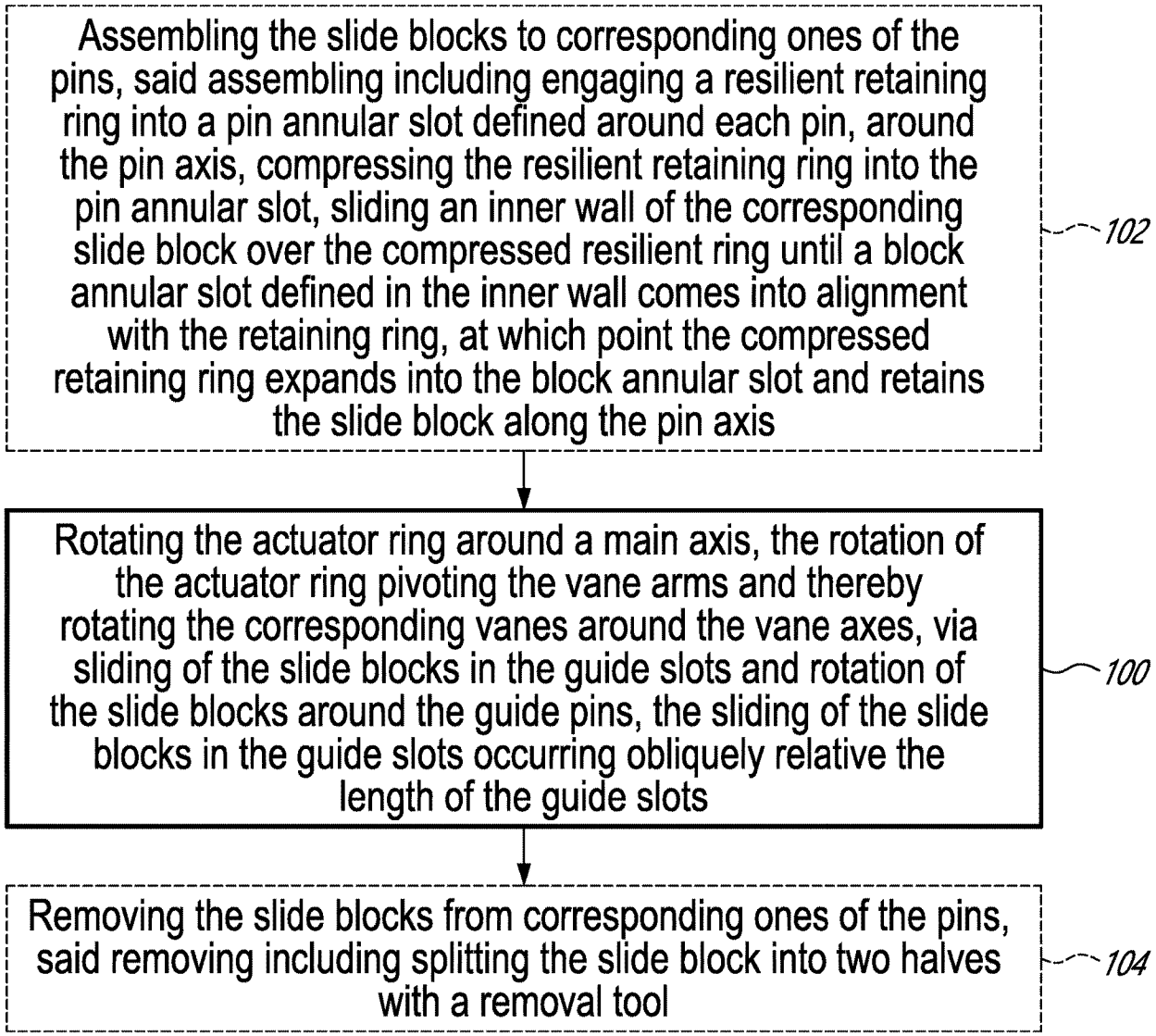
FIG. 5 is a flowchart illustrating a mode of operation of the variable vane mechanism.

In accordance with one potential mode of operation presented in FIG. 5, the method can include rotating 100 the actuator ring around a main axis, the rotation of the actuator ring pivoting the vane arms and thereby rotating the corresponding vanes around the vane axes, via sliding of the slide blocks in the guide slots and rotation of the slide blocks around the guide pins, the sliding of the slide blocks in the guide slots occurring obliquely relative the length of the guide slots.

Prior to rotating the actuator ring, the method can include assembling 102 the slide blocks to corresponding ones of the pins, said assembling including engaging a resilient retaining ring into a pin annular slot defined around each pin, around the pin axis, compressing the resilient retaining ring into the pin annular slot, sliding an inner wall of the corresponding slide block over the compressed resilient ring until a block annular slot defined in the inner wall comes into alignment with the retaining ring, at which point the compressed retaining ring expands into the block annular slot and retains the slide block along the pin axis.

Figure 6:
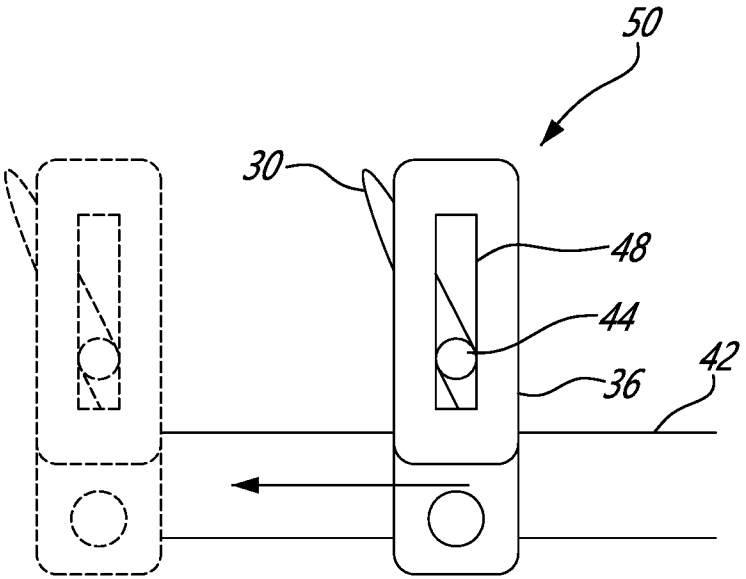
FIG. 6 is a top schematic view of an example variable vane mechanism in another configuration.

Subsequently to rotating the actuator ring, the method can include removing 104 the slide blocks from corresponding ones of the pins, said removing including splitting the slide block into two halves with a removal tool The embodiments described in this document provide non-limiting examples of possible implementations of the present technology. Upon review of the present disclosure, a person of ordinary skill in the art will recognize that changes may be made to the embodiments described herein without departing from the scope of the present technology. For example, as presented above, in an alternate embodiment, the pins can be incorporated to the vane arms, can extend generally radially outwardly or generally radially inwardly, possibly obliquely relative the main axis, and the guide slots can be formed in the actuator ring, such as schematized in FIG. 6, with like reference numerals referring to like elements. Yet further modifications could be implemented by a person of ordinary skill in the art in view of the present disclosure, which modifications would be within the scope of the present technology.

The invention claimed is:

1. A variable vane mechanism comprising:

a casing;

an actuator ring having an annular body defined about a main axis, the actuator ring being rotationally mounted to the casing for rotation about the main axis;

a set of vanes including a plurality of vanes circumferentially distributed about the main axis, each vane of the set of vanes having a vane axis extending from an inner end to an outer end, the inner end and the outer end being rotationally mounted to the casing to allow rotation of the corresponding vane about the vane axis, the vane axes extending non-parallel to the main axis, each vane having a vane arm with a vane arm length extending transversally to the vane axis;

a plurality of pins circumferentially distributed about the main axis, each pin extending along a pin axis from a first one of the actuator ring and a corresponding one of the vane arms;

a plurality of slide blocks, each slide block rotationally mounted to a corresponding one of said plurality of pins for rotation about the pin axis, each slide block having two slide block faces facing transversally opposite sides relative to the pin axis, the two slide block faces being planar and parallel to one another; and a plurality of guide slots, each guide slot defined by a second one of the actuator ring and the corresponding one of the vane arms, each guide slot having two guide slot faces that are planar and parallel to one another and a length extending away from a corresponding vane axis, each guide slot slidingly receiving a corresponding one of the slide blocks with each corresponding one of the slide block faces slidingly received by a corresponding one of the guide slot faces of the corresponding guide slot;

wherein each of the plurality of slide blocks is retained on the corresponding one of said plurality of pins along an orientation of the corresponding pin axis by a resilient retaining ring, the retaining ring extending partially into a slot defined around the corresponding one of said plurality of pins and partially into a slot defined around a central aperture of each of the plurality of slide blocks.

2. The variable vane mechanism of claim 1 wherein each pin axis intersects a corresponding one of the vane axes along the main axis.

3. The variable vane mechanism of claim 1 wherein the plurality of pins are riveted to the actuator ring.

4. The variable vane mechanism of claim 1 wherein the plurality of slide blocks each have two removal grooves extending parallel to the corresponding pin on opposite removal faces, the removal faces extending between corresponding edges of the slide block faces.

5. The variable vane mechanism of claim 1 wherein the plurality of pins protrude from the annular body and each pin axis extends away from the main axis, and wherein each of the guide slots is defined along the vane arm length.

6. The variable vane mechanism of claim 1 wherein the vane axes are each angled at least 65 degrees relative to the main axis.

7. The variable vane mechanism of claim 6 wherein the vane axes and the pin axes are each angled at least 80 degrees relative to the main axis.

8. A gas turbine engine comprising a casing defining a gas path extending sequentially across a compressor section, a combustor and a turbine section, the gas path extending annularly about a main axis, at least one rotor rotatably mounted to the casing for rotation about the main axis, the rotor having a set of blades forming part of the compressor section;

a set of vanes including a plurality of vanes circumferentially distributed about the main axis, the set of vanes being adjacent the set of blades along the gas path, each vane having a vane length extending across the gas path and being rotationally mounted at two opposite ends for rotation along a vane axis extending between the two opposite ends, each vane having a vane arm extending away from the vane axis at one of the two opposite ends;

an actuator ring having an annular body formed about the main axis, the actuator ring being rotationally mounted to the casing for rotation about the main axis;

a plurality of pins circumferentially distributed around the annular body, each pin protruding along a pin axis from a first one of the actuator ring and a corresponding one of the vane arms;

a plurality of slide blocks, each slide block rotationally mounted to a corresponding one of said plurality of pins for rotation about the pin axis, each slide block having two slide block faces facing transversally opposite sides relative to the pin axis, the two slide block faces being planar and parallel to one another; and a plurality of guide slots, each guide slot defined by a second one of the actuator ring and the corresponding one of the vane arms, each guide slot having two guide slot faces that are planar and parallel to one another and a length extending away from a corresponding vane axis, each guide slot slidingly receiving a corresponding one of the slide blocks with each corresponding one of the slide block faces slidingly received by a corresponding one of the guide slot faces of the corresponding guide slot;

wherein the plurality of slide blocks each have two removal grooves extending parallel to the corresponding pin on opposite removal faces, the removal faces extending between corresponding edges of the slide block faces.

9. The gas turbine engine of claim 8 wherein each pin axis intersects a corresponding vane axis along the main axis.

10. The gas turbine engine of claim 8 wherein each of the plurality of slide blocks is retained on a corresponding pin along an orientation of the corresponding pin axis by a resilient retaining ring, the retaining ring extending partially into a slot defined around the corresponding pin and partially into a slot defined around a central aperture of each of the plurality of slide blocks.

11. The gas turbine engine of claim 8 wherein the plurality of pins are riveted to the actuator ring.

12. The gas turbine engine of claim 8 wherein the plurality of pins protrude from the annular body and each pin axis extends away from the main axis, and wherein each guide slot is defined along the vane arm length.

13. The gas turbine engine of claim 8 wherein the vane axes and the pin axes are each angled at least 65 degrees relative the main axis.

14. A variable vane mechanism comprising:

a casing;

an actuator ring having an annular body defined about a main axis, the actuator ring being rotationally mounted to the casing for rotation about the main axis;

a set of vanes including a plurality of vanes circumferentially distributed about the main axis, each vane of the set of vanes having a vane axis extending from an inner end to an outer end, the inner end and the outer end being rotationally mounted to the casing to allow rotation of the corresponding vane about the vane axis, the vane axes extending non-parallel to the main axis, each vane having a vane arm with a vane arm length extending transversally to the vane axis;

a plurality of pins circumferentially distributed about the main axis, each pin extending along a pin axis from a first one of the actuator ring and a corresponding one of the vane arms, each pin axis intersecting a corresponding one of the vane axes along the main axis;

a plurality of slide blocks, each slide block rotationally mounted to a corresponding one of said plurality of pins for rotation about the pin axis, each slide block having two slide block faces facing transversally opposite sides relative to the pin axis; and a plurality of guide slots, each guide slot defined by a second one of the actuator ring and the corresponding one of the vane arms, each guide slot having a length extending away from a corresponding vane axis, each guide slot slidingly receiving a corresponding one of the slide blocks with each corresponding one of the slide block faces slidingly received by a corresponding one of the guide slot faces of the corresponding guide slot.

15. The variable vane mechanism of claim 14 wherein the vane axes are each angled at least 65 degrees relative to the main axis.

16. The variable vane mechanism of claim 15 wherein the vane axes and the pin axes are each angled at least 80 degrees relative to the main axis.

17. The variable vane mechanism of claim 14, wherein each of the plurality of slide blocks is retained on the corresponding one of said plurality of pins along an orientation of the corresponding pin axis by a resilient retaining ring, the retaining ring extending partially into a slot defined around the corresponding one of said plurality of pins and partially into a slot defined around a central aperture of each of the plurality of slide blocks.

18. The variable vane mechanism of claim 14 wherein the plurality of pins are riveted to the actuator ring.

19. The variable vane mechanism of claim 14 wherein the plurality of slide blocks each have two removal grooves extending parallel to the corresponding pin on opposite removal faces, the removal faces extending between corresponding edges of the slide block faces.

20. The variable vane mechanism of claim 14 wherein the plurality of pins protrude from the annular body and each pin axis extends away from the main axis, and wherein each of the guide slots is defined along the vane arm length.

* * * * *